US009266358B2

(12) United States Patent
Seki et al.

(10) Patent No.: US 9,266,358 B2
(45) Date of Patent: Feb. 23, 2016

(54) INKJET PRINTING DEVICE AND INKJET PRINTING METHOD

(71) Applicant: MIMAKI ENGINEERING CO., LTD., Nagano (JP)

(72) Inventors: Akifumi Seki, Nagano (JP); Masaru Ohnishi, Nagano (JP); Kazuya Nozaki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/686,788

(22) Filed: Apr. 15, 2015

(65) Prior Publication Data

US 2015/0298469 A1 Oct. 22, 2015

(30) Foreign Application Priority Data

Apr. 17, 2014 (JP) ..... 2014-085856

(51) Int. Cl.

| | |
|---|---|
| ***B41J 2/01*** | (2006.01) |
| ***B41F 23/04*** | (2006.01) |
| ***B41F 23/06*** | (2006.01) |
| ***B41J 11/00*** | (2006.01) |

(52) U.S. Cl.

CPC ..... *B41J 11/0015* (2013.01); *B41F 23/04* (2013.01); *B41F 23/06* (2013.01); *B41J 11/002* (2013.01); *B41J 2/01* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,869,698 | B2 * | 10/2014 | De Joseph et al. | 101/451 |
| 2001/0022607 | A1 * | 9/2001 | Takahashi et al. | 347/103 |

FOREIGN PATENT DOCUMENTS

| | | |
|---|---|---|
| JP | 2012171187 | 9/2012 |
| JP | 2013159056 | 8/2013 |

OTHER PUBLICATIONS

Computer-generated translation of JP 2012-171187, published on Sep. 2012.*
Computer-generated translation of JP 2013-159056, published on Aug. 2013.*

* cited by examiner

*Primary Examiner* — Huan Tran
(74) *Attorney, Agent, or Firm* — Jianq Chyun IP Office

(57) ABSTRACT

The disclosure provides a novel inkjet printing device advantageously equipped to prevent the occurrence of blocking. The inkjet printing device includes: an inkjet head for discharging an ink on a medium to carry out printing; a transferring roller for moving the medium and the inkjet head relative to each other; and a powdering applying unit for applying a powder on the medium, wherein the powdering applying unit is located on a downstream side relative to the inkjet head in a transferring direction by the transferring roller.

10 Claims, 6 Drawing Sheets

INKJET PRINTING DEVICE AND INKJET PRINTING METHOD

CROSS REFERENCE TO RELATED APPLICATIONS

This application claims the priority benefit of Japan application serial no. 2014-085856, filed on Apr. 17, 2014. The entirety of the above-mentioned patent application is hereby incorporated by reference herein and made a part of this specification.

TECHNICAL FIELD

The disclosure relates to an inkjet printing device and an inkjet printing method.

DESCRIPTION OF THE BACKGROUND ART

Patent literature 1 describes a particle dispersion liquid supply device directed at controlling the occurrence of stacker blocking, wherein particles are adhered to an image-formed surface of a recording medium to prevent fly-off of the particles.

Patent literature 2 describes an inkjet recording device including a printing unit that carries out printing through movements of an inkjet head relative to a recording medium, and a powder applying portion that applies a blocking preventive powder on an already printed part of the recording medium after the printing is done by the printing unit.

[Patent literature 1] Japanese Laid-Open Patent Application No. 2012-171187A (disclosed on Sep. 10, 2012)

[Patent literature 2] Japanese Laid-Open Patent Application No. 2013-159056A (disclosed on Aug. 19, 2013)

SUMMARY

However, neither of the techniques described in Japanese Laid-Open Patent Application No. 2012-171187A and Japanese Laid-Open Patent Application No. 2013-159056A can independently offer a perfect solution to all of the issues that users are to deal with. Therefore, a novel inkjet printing device advantageously equipped to prevent the occurrence of blocking is desired.

To solve the problem, the disclosure provides a novel inkjet printing device equipped to prevent the occurrence of blocking.

An inkjet printing device according to the disclosure includes: an inkjet head for discharging an ink on a recording medium to carry out a printing; a transferring unit for moving the recording medium and the inkjet head relative to each other; and a powder applying unit for applying a powder on the recording medium, the powder applying unit being located on a downstream side relative to the inkjet head in a transferring direction by the transferring unit.

According to the device thus characterized, when the recording medium is, for example, wound in a roll to be retrieved, the ink on the recording medium is prevented from bleeding through to or sticking (blocking) to a back surface of the recording medium opposite to its ink-discharged surface. The device thus advantageous can prevent such an incident that some mottled effect is left on the ink-discharged surface of the recording medium.

The device can also prevent the occurrence of blocking of a semi-dried printed matter by applying the powder thereon after the printing is done by the inkjet printing device. This shortens an idle time before the recording medium is ready to be wound in a roll to be retrieved. The inkjet printing device can accordingly improve its printing speed.

This also allows a stage of the device necessary for drying the printed recording medium to reduce in length, thereby succeeding in downsizing the inkjet printing device.

In the inkjet printing device according to the disclosure, the powder applying unit may include a serial powdering unit that moves in a direction intersecting the transferring direction and applies the powder.

Such a powder applying unit can equally apply the powder even on wide recording media.

In the inkjet printing device according to the disclosure, the serial powdering unit may include a feeder for supplying the powder, and an applicator for stirring and applying the powder supplied from the feeder.

With this configuration, the powder supplied from the feeder is stirred by the applicator, and aggregated particles of the powder can be thereby loosened. After the aggregated particles are loosened by the applicator, the powder can be equally applied on the recording medium.

In the inkjet printing device according to the disclosure, the serial powdering unit preferably moves in a larger extent than a printing width of the inkjet head.

The powdering unit thus characterized can spread an adequate quantity of powder on, for example, an image printed by discharging an ink, far enough to reach edges of the image. This avoids any insufficiency of the powder to be applied on the recording medium, more effectively preventing the occurrence of blocking.

In the inkjet printing device according to the disclosure, the powder applying unit may have a tube with a plurality of through holes formed therein, wherein the powder supplied into the tube is applied on the recording medium through the plurality of through holes.

The powder can be applied on the recording medium by such a simple structure.

In the inkjet printing device according to the disclosure, the powder applying unit preferably applies the powder on a back surface of the recording medium opposite to its ink-discharged surface when the transferred recording medium is returning in a direction reverse to the transferring direction.

With this configuration, at the time of retrieving the recording medium by using, for example, a take-up roll, the powder applying unit applies the powder on the back surface opposite to the ink-discharged surface. This serves the purpose of preventing the occurrence of blocking of the ink-discharged surface.

The device structured to return the recording medium in the direction reverse to the transferring direction allows reduction in length of a stage of the device for transferring the recording medium, thereby succeeding in downsizing the inkjet printing device.

The inkjet printing device according to the disclosure preferably further includes an after-heating unit for heating the ink printed on the recording medium between the powder applying unit and the inkjet head.

With the after-heating unit further installed in the device, the ink discharged on the recording medium can be thereby heated to prevent possible failure to fully dry the ink. This more effectively prevents the occurrence of blocking.

The inkjet printing device according to the disclosure preferably further includes a cooling unit for cooling the recording medium, wherein the cooling unit is located on a downstream side relative to the after-heating unit and on at least one of upstream and downstream sides relative to the powder applying unit in the transferring direction.

The cooling unit further installed in the device can cool the ink discharged on the recording medium subsequent to the heat drying by the after-heating unit. Then, an ink layer becomes cool enough to reach temperatures lower than the glass-transition temperature of a resin contained in the ink, reducing a degree of heat-induced tackiness of the ink layer. This can prevent the powder from infiltrating into the ink layer, roughening the surface of the ink layer when the printed recording medium is, for example, wound in a roll to be retrieved.

An inkjet printing method according to the disclosure includes: a printing step of discharging an ink on a recording medium through an inkjet head to carry out printing; a transferring step of moving the recording medium and the inkjet head relative to each other; and a powder applying step of applying a powder on the recording medium on a downstream side relative to the inkjet head in a transferring direction during the transferring step.

The method exerts advantageous effects similar to the effects with the inkjet printing device according to the disclosure.

The disclosure provides a novel inkjet printing device advantageously equipped to prevent the occurrence of blocking.

DETAILED DESCRIPTION OF EXEMPLARY EMBODIMENTS

An inkjet printing device according to the disclosure includes: an inkjet head for discharging an ink on a recording medium to carry out printing; a transferring unit for moving the recording medium and the inkjet head relative to each other; and a powder applying unit for applying a powder on the recording medium, wherein the powder applying unit is located on a downstream side relative to the inkjet head in a transferring direction by the transferring unit.

According to the above configuration, for example, when the recording medium is wound in a roll to be retrieved, the ink on the recording medium is prevented from bleeding through to or sticking (blocking) to a back surface of the recording medium opposite to its ink-discharged surface. The inkjet printing device thus advantageous can prevent such an incident that some mottled effect is left on the ink-discharged surface of the recording medium.

After the printing is done by the inkjet printing device, an occurrence of blocking of a semi-dried printed matter by applying the powder thereon can be prevented. This can shorten an idle time before the recording medium is ready to be wound in a roll to be retrieved. The inkjet printing device can accordingly improve its printing speed. The "semi-dried" indicates a state of an ink layer of for example, an image printed on the recording medium, in which the ink layer has a surface forming a film but is still uncured inside.

Moreover, a stage of the inkjet printing device necessary for drying the printed recording medium can be reduced in length. Thus, the inkjet printing device can be downsized.

[Inkjet Printing Device 100]

An embodiment of the disclosure is hereinafter described in detail referring to FIG. 1. FIG. 1 is a schematic drawing of an inkjet printing device 100 according to an embodiment (first embodiment) of the disclosure.

Figure 1A:
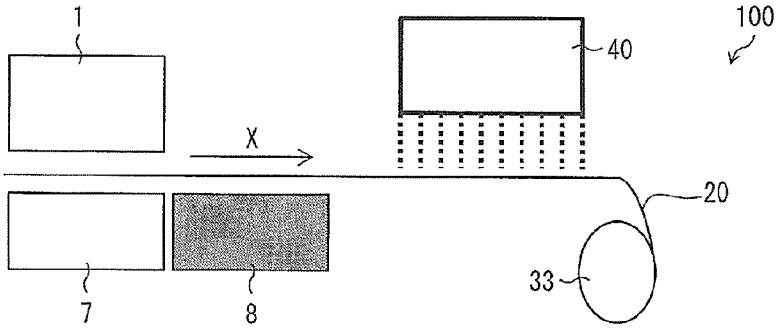
FIG. 1A-1C are schematic drawings of an inkjet printing device according to an embodiment (first embodiment) of the disclosure.

As illustrated in FIG. 1A, the inkjet printing device 100 according to the embodiment of the disclosure includes: an inkjet head 1 for discharging an ink on a medium (recording medium) 20 to carry out printing; a transferring portion (transferring unit, not illustrated in the drawing) for moving the medium 20 and the inkjet head 1 relative to each other; and a powdering equipment (powder applying unit) 40 for applying a powder on the medium 20, wherein the powdering equipment 40 is located on a downstream side relative to the inkjet head 1 in a transferring direction by the transferring unit.

Figure 1B:
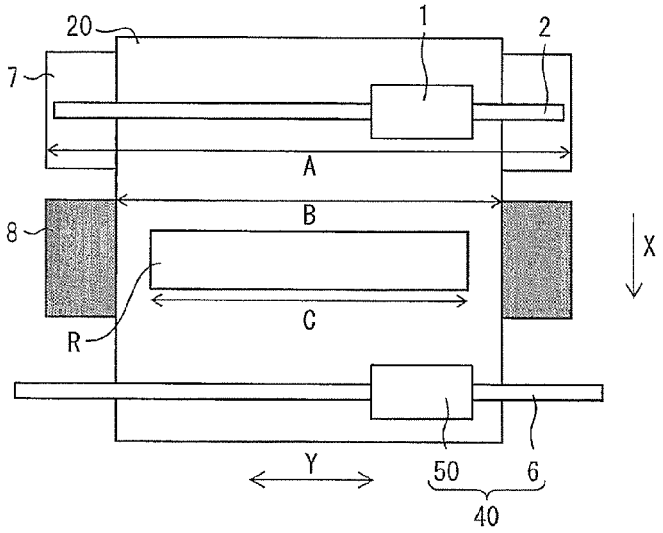

As illustrated in FIG. 1B, the powdering equipment 40 includes a serial powdering unit 50 and a Y-bar 6.

Figure 3A:
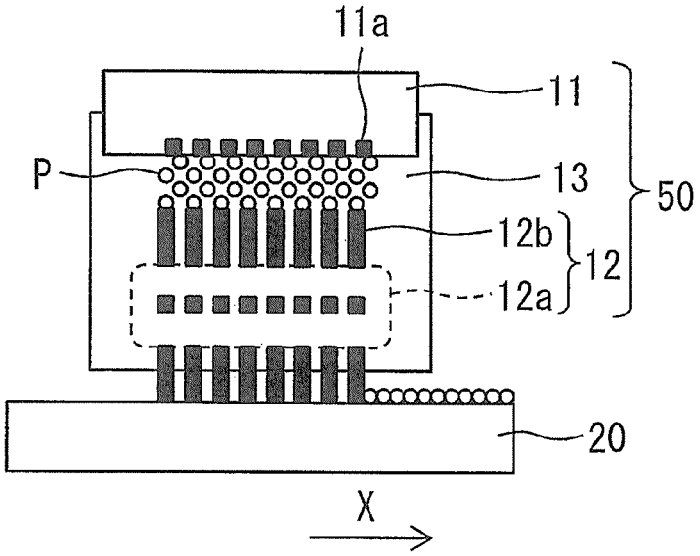
FIGS. 3A-3C are schematic drawings of a serial powdering unit installed in the inkjet printing device according to the embodiment of the disclosure.
Figure 3B:
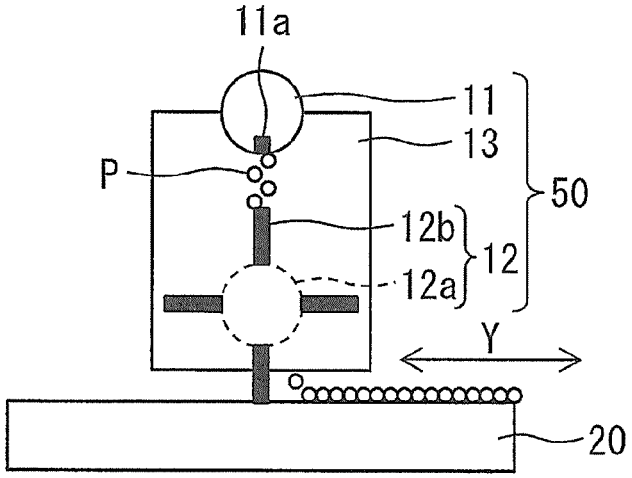

As illustrated in FIGS. 3A and 3B, the serial powdering unit 50 has a feeding bottle (feeder) 11 and a powdering roller (applicator) 12.

The inkjet printing device 100 according to the embodiment further includes: a take-up roll 33, a platen 7, and an after-heating unit 8.

The inkjet printing device 100 discharges the ink on the medium 20 to carry out an inkjet printing. The inkjet printing device 100 according to the embodiment is a serial-head inkjet printing device, wherein the ink is discharged on the recording medium through the inkjet head moving in a direction (main scanning direction) intersecting the transferring direction of the recording medium (sub-scanning direction). However, the inkjet printing device according to the disclosure is not limited to such an inkjet printing device. Another example of the inkjet printing device is a line-head inkjet printing device that discharges an ink through a relatively long inkjet head immovably positioned, wherein the ink is discharged while transferring a recording medium alone.

The inkjet printing device may be a large flatbed inkjet printing device with one of such inkjet heads, wherein printing can be continuously performed on a large medium immovably positioned.

In the inkjet printing device, either one of the inkjet head and the medium may be optionally moved relative to each other. For relative movements between the medium and the inkjet head, the medium may be transferred, or the printing unit with the inkjet head may be moved in a direction intersecting the scanning direction.

[Inkjet Head 1]

The inkjet head 1 is used to discharge an ink on the medium 20 to print an object thereon. The inkjet head 1 is mounted on a carriage (not illustrated in the drawing) movably along the Y-bar 2. The inkjet head 1 can accordingly move along the Y-bar 2 in the scanning direction (Y direction) intersecting the transferring direction (X direction).

The inkjet head 1, while moving on the medium 20, discharges the ink on the medium 20. The inkjet head 1 may include, but is not limited to, an inkjet head with nozzles that respectively discharge inks in such colors alone; yellow (Y), magenta (M), cyan (C), and black (K). In addition to the Y, M, C, and K inks, the inkjet head 1 may further have nozzles that respectively discharge inks in, for example, metallic, white, pearl, and fluorescent colors. The inkjet head 1 may instead discharge one color ink only.

[Transferring Unit]

The transferring unit transfers the medium 20 for relative movements between the medium 20 and the inkjet head 1. The inkjet printing device 100 carries out printing through the inkjet head 1 with the medium 20 being transferred by the transferring unit. The inkjet printing device 100 thus characterized can continuously perform printing on the medium 20.

The transferring unit is located in vicinity of the upstream or downstream side in the transferring direction relative to a position at which printing is performed on the medium 20. By driving the transferring unit, the medium 20 can be transferred. The transferring unit includes, for example, rollers on which the medium 20 can be carried. To transfer the medium 20, for example, the medium 20 may be pushed into between two rollers and rotated together with a certain degree of pressure being imposed on the medium 20.

[Take-Up Roll 33]

The take-up roll 33 winds the printed medium 20 around its outer periphery to retrieve the medium 20 in the form of a roll. The take-up roll 33 is located on the downstream side in the transferring direction (X direction) of the medium 20. By driving the take-up roll 33 in coordination with the transferring unit, the medium 20 transferred by the transferring unit is prevented from slackening when wound around the take-up roll. The take-up roll 33, in order to wind the medium 20 around it, may be rotated in accordance with a moving speed of the medium 20 moved by the transferring unit. In the case of moving the medium 20 by the rotational force of the take-up roll 33, the take-up roll 33 may well be said to be a structural element of the transferring unit.

[Powdering Equipment 40]

The powdering equipment 40 is described below referring to FIGS. 1 and 3. The powdering equipment 40 is used to apply powder on the ink-discharged medium 20 (FIG. 1A), and has the serial powdering unit 50 and Y-bar 6 (FIG. 1B). The serial powdering unit 50 has the feeding bottle (feeder) 11 that supplies the powder, and the powdering roller 12 that stirs and applies the powder supplied from the feeding bottle 11 (FIGS. 3A and 3B).

[Serial Powdering Unit 50]

In the inkjet printing device 100 according to the disclosure, as illustrated in FIG. 1B, the powdering equipment 40 includes the serial powdering unit 50 that moves in the scanning direction (Y direction) intersecting the transferring direction (X direction) and applies the powder.

The serial powdering unit 50 is installed in the inkjet printing device 100 in a manner that can move along the Y-bar 6. The serial powdering unit 50 can accordingly apply the powder on the ink-discharged surface while moving in the Y direction along the Y-bar 6 (FIG. 1B). Therefore, the serial powdering unit 50 of the inkjet printing device 100 can be designed in a smaller size, and the powder can be adequately applied on media large in width.

Figure 1C:
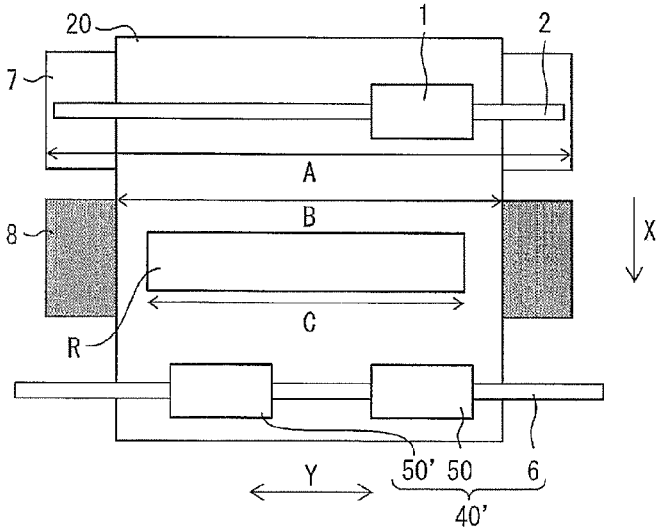

As illustrated in FIG. 1B, the serial powdering unit 50 of the inkjet printing device 100 according to the embodiment can move in a larger extent than a printing width of the inkjet head 1. Specifically, as illustrated in FIG. 1B, the serial powdering unit 50 is allowed to move across a width dimension A that is the width of the platen 7, a width dimension B that is the width of the medium 20, and a width dimension C that is the width of a printing region R. The serial powdering unit 50 thus characterized can spread an adequate quantity of powder on, for example, an image printed by discharging the ink, far enough to reach edges of the image. This can avoid any insufficiency of the powder to be applied on the medium 20, more effectively preventing the occurrence of blocking. Whether the serial powdering unit 50 is moved in the width dimension A, B, or C illustrated in FIG. 1B is preconfigured in a device that controls the serial powdering unit 50. The moving distance of the serial powdering unit 50 is controlled corresponding to the width dimension A, B, or C. The printing region R illustrated in FIGS. 1B and 1C represents a region of the medium 20 on which an object is to be printed by the inkjet head 1.

Therefore, an adequate quantity of powder can be spread on, for example, an image printed by discharging the ink, far enough to reach edges of the image. This can avoid any insufficiency of the powder, more effectively preventing the occurrence of blocking.

[Feeding Bottle 11]

As illustrated in FIG. 3A, the feeding bottle 11 is a container for reserving the powder to be applied by the serial powdering unit 50 and supplying the powder to the powdering roller 12. The feeding bottle 11 supplies the powder to the powdering roller 12 through a plurality of through holes 11*a*. In this manner, the feeding bottle 11 is prevented from oversupplying the powder to the powdering roller 12.

The feeding bottle 11 is removably attached to a powdering head 13 of the serial powdering unit 50. Therefore, when all of the powder reserved in the feeding bottle 11 is used up, the feeding bottle 11 is replaced with a new one to continue the powder supply.

[Powdering Roller 12]

As illustrated in FIGS. 3A and 3B, the powdering roller (applicator) 12, while stirring the powder supplied from the feeding bottle 11, applies the stirred powder on the medium 20. The powdering roller 12 is a brush-like member with a rotating shaft 12*a* and a large number of bristles 12*b*. The powdering roller 12 is attached to the powdering head 13 in a manner that rotates around the rotating shaft 12*a*.

The powdering roller 12 can effectively stir the powder supplied from the feeding bottle 11 by using the rotating multiple bristles 12*b*. The powdering roller 12 can accordingly loosen aggregated particles of the powder supplied from the feeding bottle 11. After the aggregated particles are loosened by the powdering roller 12, the powder is immediately applied by the powdering roller 12 on the medium 20. The powder can accordingly be applied equally on the medium 20.

The powdering roller 12 is mounted on the powdering head 13 so that the lengthwise direction of the rotating shaft 12*a* intersects the Y direction that is the scanning direction of the serial powdering unit 50. The edges of the bristles 12*b* of the powdering roller 12 are brought into contact with the platen 7 or the medium 20 by the movement of the serial powdering unit 50. When the serial powdering unit 50 is moving in the Y direction along the Y-bar, the bristles 12*b* in contact with the platen 7 or medium 20 turn around, rotating the powdering roller 12.

The powdering roller 12 is formed so that the lengthwise direction intersects the Y direction that is the scanning direction of the serial powdering unit 50. Even using the powdering head 13 smaller in size, the serial powdering unit 50 can still apply the powder in one scan in an area large enough. Thus, the powdering head 13 and the serial powdering unit 50 can be reduced in size.

The powdering roller 12 may be rotated by a driving unit (not illustrated in the drawings), such as a motor, installed in an end part of the rotating shaft 12*a* in its lengthwise direction. This structural option allows the powdering roller 12 to adequately stir the powder supplied from the feeding bottle 11 and apply the stirred powder on the medium 20.

[Platen 7]

The platen 7 is a loading stand positioned so as to face nozzles (not illustrated in the drawings) of the inkjet head 1. The platen 7 has a printing heater embedded therein. The platen 7 with the printing heater heats the medium 20 from the back surface of the medium 20 opposite to the printed surface to heat the ink discharged on the medium 20.

The platen 7 preferably heats the ink on the medium 20 at temperatures equal to or higher than 30° C. and equal to or lower than 90° C., and more preferably at temperatures equal to or higher than 40° C. and equal to or lower than 70° C. Heating the ink at temperatures equal to or higher than 40° C. can increase the viscosity of the ink in a short period of time by evaporating the solvent in the ink, while heating the ink at temperatures equal to or lower than 70° C. can better control the occurrence of cockling with recording media inferior in heat resistance made from, for example, vinyl chloride.

A preheating unit for heating the medium 20 may be further installed on the upstream side relative to the platen 7 in the transferring direction of the medium 20. Preheating the medium 20 by using the preheating unit can efficiently evaporate a solvent contained in the ink discharged on the medium 20. In the case where the medium 20 is a recording medium inferior in heat resistance made from, for example, vinyl chloride, the platen 7 at high temperatures is likely to provoke the occurrence of cockling. Preheating the medium 20 by using the preheating unit makes it unnecessary to heat the platen 7 to high temperatures, effectively avoiding the occurrence of cockling.

[After-Heating Unit 8]

The inkjet printing device 100 according to the embodiment preferably further includes an after-heating unit 8 as a heating unit for heating the ink printed on the medium 20 between the powdering equipment 40 and the inkjet head 1. The after-heating unit 8 heats the medium 20 from the back surface opposite to the ink-discharged surface of the medium 20.

The after-heating unit 8 can heats and volatilizes the solvent of the ink not completely volatilized even after the heating by the platen 7. The after-heating unit 8 can, therefore, suitably avoid insufficient dryness of the ink. Subsequent to the heating by the after-heating unit 8, the powdering equipment 40 applies the powder on the ink-discharged surface, effectively preventing the occurrence of blocking that may result from failure to fully dry the ink.

[Ink]

Examples of the ink used in the inkjet printing device 100 are latex inks, water-based inks, solvent inks, and inks of ultraviolet curing type.

[Latex Ink]

The latex ink contains water or an organic solvent and further contains a resin, in which the resin is emulsified or suspended in the organic solvent or water.

The latex ink may be a water-based latex ink in which a resin is emulsified or suspended in water. The water-based latex ink contains a water-based emulsion or a water-based suspension formed by the resin.

Examples of the resin are water-soluble vinyl-based resins, acrylic resins, alkyd-based resins, polyester-based resins, polyurethane-based resins, silicon-based resins, fluororesins, epoxy-based resins, phenoxy-based resins, polyolefin-based resins, and modified resins obtained from these resins. Of these examples, acrylic resins, water-soluble polyurethane-based resins, water-soluble polyester-based resins, and water-soluble acrylic resins are preferably used, and acrylic resins are particularly preferable. The resin contained in the water-based latex ink may be a resin solely used, or two or more different resins may be combined and used.

The content of the resin in the water-based latex ink may be optionally decided depending on the type of the resin. For example, the resin content is preferably equal to or greater than 1 wt. %, and more preferably equal to or greater than 2 wt. % with respect to the whole quantity of the water-based latex ink. Also, the resin content is preferably equal to or less than 20 mass %, and more preferably equal to or less than 10 mass % with respect to the whole quantity.

The latex ink may further contain a coloring matter such as an organic pigment, an inorganic pigment, or a dyestuff. The color of the latex ink is not necessarily limited to yellow (Y), magenta (M), cyan (C), or black (K). The color may be suitably toned to obtain a metallic, white, pearl or fluorescent color ink depending on an intended use.

The latex ink may further contain an emulsifier to emulsify or suspend the resin.

The organic solvent or water of the latex ink may contain another resin dissolved therein in addition to the emulsified or suspended resin. This additional resin may be dissolved in the organic solvent or water to adjust the viscosity of the ink. After the ink is dehydrated by drying, particles of the emulsified or suspended resin are bonded to form a film. At the time, the additional resin may serve as a binding material that further strengthens the bond between the particles of the emulsified or suspended resin. Therefore, the latex ink is curable by drying or heating.

The latex ink is unlikely to merge into images printed with other types of inks. Such an advantage makes the latex ink useful for protection of images printed with other inks. Another advantage of the latex ink is its applicability to various kinds of recording media. On the other hand, the occurrence of blocking is more likely with the latex ink due to its high resin viscosity unless the organic solvent or water is dry enough. When the latex ink is used for printing by the inkjet printing device 100 according to the disclosure, the device 100 can make full use of its advantages, while effectively preventing the blocking that may occur if the latex ink is not dry enough.

[Other Inks]

Also using inks other than the latex ink for printing by the inkjet printing device 100 according to the disclosure, the device 100 can certainly prevent the occurrence of blocking. The ink may be a water-based ink containing water, or a solvent ink containing a solvent other than water. The inkjet printing device may further include an ultraviolet lamp, in which case an ink of ultraviolet curing type may be used for printing. The ink may be suitably selected depending on the type of the recording medium and the intended use of an obtained printed matter.

[Medium 20]

The medium 20 is a recording medium on which an object is printed with the ink discharged through the inkjet head 1. The medium used by the inkjet printing device 100 is suitably decided depending on purposes. Examples of the medium 20 are a plate-shaped member, a sheet-like member, and a web-like member.

[Powder]

In the inkjet printing device 100 according to the embodiment, examples of the powder to be applied on the medium 20 by the serial powdering unit 50 may include starches, silica, acrylic resins, polystylene resins, aluminum hydroxide, titanium oxide, and alumina. The starches and silica, if used, may be subject to a water-repellent surface finishing.

The powder is preferably a powder having an average particle size equal to or greater than 0.1 μm and equal to or less than 50 μm, and more preferably a powder having an average particle size equal to or greater than 0.5 μm and equal to or less than 10 μm. The powder with an average particle size between 0.1 μm and 50 μm can suitably fly about in the air inside the serial powdering unit 50.

[Inkjet Printing Device 101]

Figure 2:
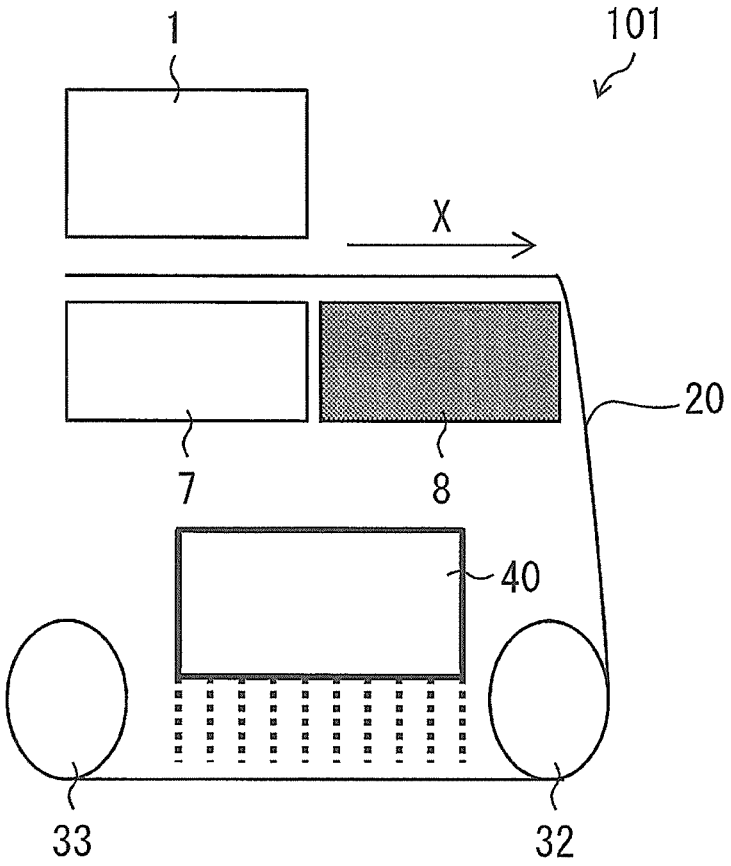
FIG. 2 is a schematic drawing of an inkjet printing device according to an embodiment (second embodiment) of the disclosure.

An inkjet printing device 101 according to an embodiment (second embodiment) of the disclosure is described referring to FIG. 2.

The description of this embodiment focuses on differences from the first embodiment. Any structural elements of the device functionally similar to those according to the first embodiment are given the same reference symbols, and will not be described again.

In the inkjet printing device 101 according to the embodiment, as illustrated in FIG. 2, the powdering equipment 40 applies the powder on the back surface of the medium 20 opposite to its ink-discharged surface when the transferred medium 20 is returning in the direction reverse to the transferring direction immediately below the inkjet head 1. A return roller 32 is used to return the medium 20 in the direction reverse to the transferring direction.

[Return Roller 32]

The return roller 32 transfers the medium 20 in the direction reverse to the transferring direction. The return roller 32 is located on the downstream side in the transferring direction relative to a position at which the printing is performed on the medium 20. By driving the return roller 32, the medium 20 is transferred by the frictional force of the return roller 32. The return roller 32 is driven in coordination with the take-up roll 33 and a transferring roller. The medium 20 transferred by the transferring roller and the return roller 32 is prevented from slackening when wound around the take-up roll 33.

In the inkjet printing device 101 according to the embodiment, when the medium 20 is returned by the return roller 32 in the direction reverse to the transferring direction, the back surface of the medium 20 opposite to its ink-discharged is turned upward. Therefore, the powdering equipment 40 can apply the powder on the back surface opposite to the ink-discharged surface as illustrated in FIG. 2.

After the powdering equipment 40 applies the powder on the back surface opposite to the ink-discharged surface, the medium 20 is wound in a roll by the take-up roll 33. The medium 20 is wound around the take-up roll 33 in a manner that the ink-discharged surface of the medium 20 contacts the powder-applied surface thereof. The powder applied on the back surface opposite to the ink-discharged surface serves to prevent the occurrence of blocking of the ink-discharged surface.

The return roller 32 can turn the direction of the transferred medium 20. As a result, a stage of the device for transferring the medium 20 can reduce in length as compared to the stage according to the first embodiment, allowing downsizing of the inkjet printing device 101.

[Inkjet Printing Device 102]

Figure 5A:
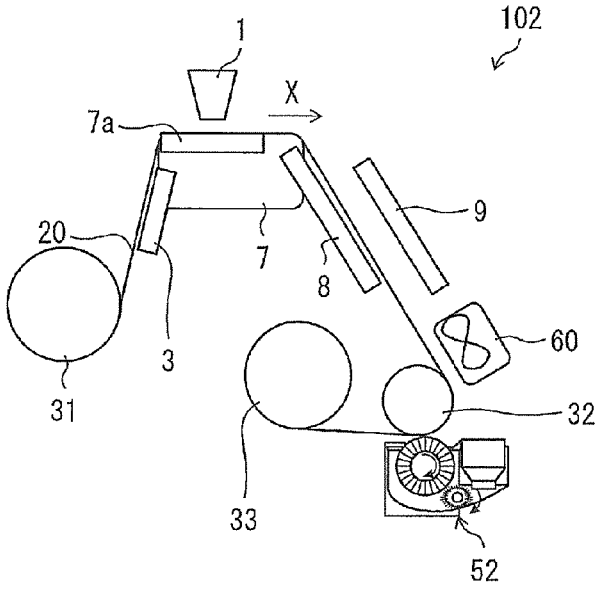
FIGS. 5A-5C are schematic drawings of an inkjet printing device according to embodiments (third and fourth embodiments) of the disclosure.
Figure 5B:
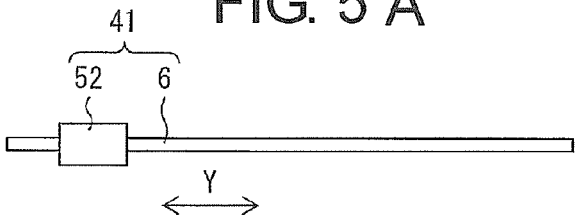

An inkjet printing device 102 according to an embodiment (third embodiment) of the disclosure is described referring to FIGS. 5A and 5B. This embodiment hereinafter describes a laminate solution spread on the ink layer formed by the ink discharged on the medium 20. The laminate solution serves the purpose of protecting the ink layer.

The description of this embodiment focuses on differences from the first embodiment. Any structural elements of the device functionally similar to those according to the first embodiment are given the same reference symbols, and will not be described again.

As illustrated in FIG. 5A, in addition to the transferring roller 31 as a transferring unit, platen 7, printing heater 7*a*, after-heating unit 8, return roller 32, and take-up roll 33, the inkjet printing device 102 according to the embodiment also includes a preheating unit 3, a far infrared heating unit 9, a serial powdering unit 52, and a cooling unit 60. The inkjet printing device 102 further includes a laminate coating head (not illustrated in the drawings).

In the inkjet printing device 102, the return roller 32 is located in contact with the back side of the medium 20 opposite to its printed surface, and the powder is applied by the serial powdering unit 52 on the ink-discharged surface of the medium 20. The inkjet printing device thus structured can be reduced in width in the X direction as with the inkjet printing device 101 according to the second embodiment.

[Preheating Unit 3]

The preheating unit 3 for heating the medium 20 is located on the upstream side relative to the inkjet head 1 in the transferring direction of the medium 20 transferred from the transferring roller 31. Therefore, the medium 20 can be preheated before its ink-discharged surface arrives at a position underneath the inkjet head 1. Preheating the medium 20 makes it unnecessary to heat the platen 7 to high temperatures by the printing heater 7*a*, effectively avoiding the occurrence of cockling. Further, the ink discharged on the medium 20 can be readily heated, which prevents blurring of the ink.

[Laminate Coating Head]

The laminate coating head spreads the laminate solution on the ink layer printed through the inkjet head 1 to protect the ink layer. Examples of the laminate coating head are an inkjet head, a spray gun, a Bubble Jet (registered trademark) head, and a liquid coater.

The laminate coating head is preferably at a position distant from the inkjet head 1 so that the ink discharged through the inkjet head 1 is not blurred by the laminate solution.

The distance between the inkjet head 1 and the laminate coating head is suitably decided based on the moving speed of the medium 20 in the transferring direction and the drying time of the ink. The drying time of the ink is, for example, a period of time that allows for sufficient dryness of the ink that is not blurred by the laminate solution. A criterion for determining whether the ink is dry enough is preferably an amount of evaporation of the solvent contained in the ink. Once the solvent of the ink discharged on the medium 20 has been evaporated by 20% or more of a total ink weight before the discharge starts, the ink is dry enough and not blurred by the laminate solution. The drying time of the ink is calculated based on the amount of evaporation of the solvent and heating conditions, and the distance between the inkjet head 1 and the laminate coating head is then decided.

The laminate coating head is located on the upstream side relative to the serial powdering unit 52 in the transferring direction of the medium 20. The distance between the laminate coating head and the serial powdering unit 52 is suitably decided based on the moving speed of the medium 20 in the transferring direction and drying time of the ink and the laminate solution. A criterion for determining whether the ink and the laminate solution are dry enough is preferably an amount of evaporation of the solvents. Once the solvents of the ink and the laminate solution have been evaporated by 85 wt. % or more, the ink layer and the laminate layer are dry enough. The drying time of the ink and the laminate solution is calculated based on the mounts of evaporation of the solvents and heating conditions, and the distance between the laminate coating head and the serial powdering unit 52 is then decided.

[Far-Infrared Heating Unit 9]

The far-infrared heating unit 9 delivers far-infrared ray on and thereby heats the surface of the medium 20 with the ink layer and the laminate layer formed thereon. The discharged ink and the spread laminate solution on the medium 20 are thereby heated and adequately dried.

The far-infrared heating unit 9 preferably faces the after-heating unit 8 so that the medium 20 transferred in the transferring direction is interposed therebetween. The both surfaces of the medium 20 are heated by the after-heating unit 8 and the far-infrared heating unit 9. Then, 85 wt. % or more of the solvents contained in the ink and the laminate solution can be more quickly evaporated.

[Cooling Unit 60]

The cooling unit 60 cools the medium 20 heated by the after-heating unit 8 and the far-infrared heating unit 9. Cooling the medium 20 reduces a degree of tackiness imparted by heating the ink layer and the laminate layer formed on the medium 20. This can prevent the powder from infiltrating into the laminate layer, roughening its surface when the printed medium 20 is, for example, wound in a roll to be retrieved. The cooling unit 60 installed in the inkjet printing device cools the heated medium 20, allowing the powder to be readily applied on the medium 20.

The cooling unit 60 may be a cooling fan or a heat sink.

The laminate solution may not be used in the inkjet printing device. Even so, providing the cooling unit 60 is still useful for reducing a degree of tackiness of the ink layer.

[Serial Powdering Unit 52]

In the inkjet printing device 102, as illustrated in FIGS. 5A and 5B, the serial powdering unit 52 applies the powder. The serial powdering unit 52 is installed in the inkjet printing device 102 in a manner that can move in the Y direction along the Y-bar 6 as illustrated in FIG. 5B.

Figure 6A:
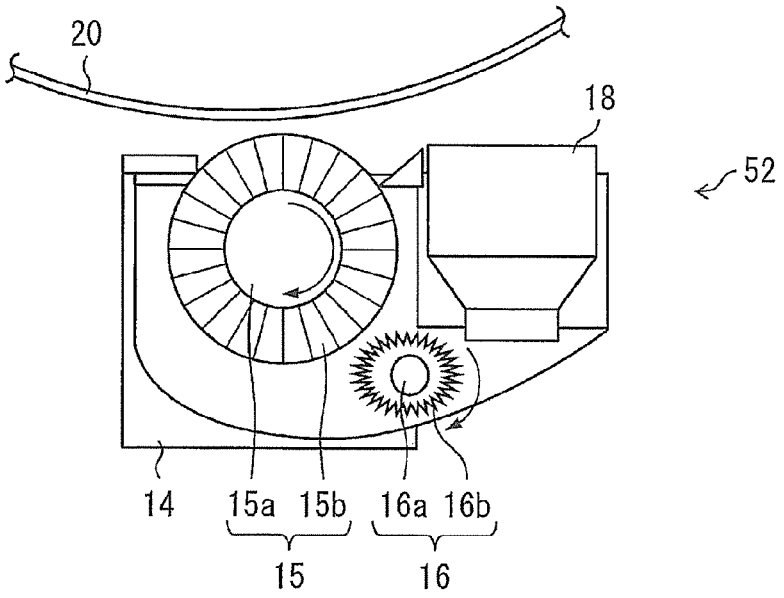
FIGS. 6A-6B are schematic drawings of a serial powdering unit according to the modified embodiment installed in the inkjet printing device according to the embodiments of the disclosure (third and fourth embodiments).
Figure 6B:
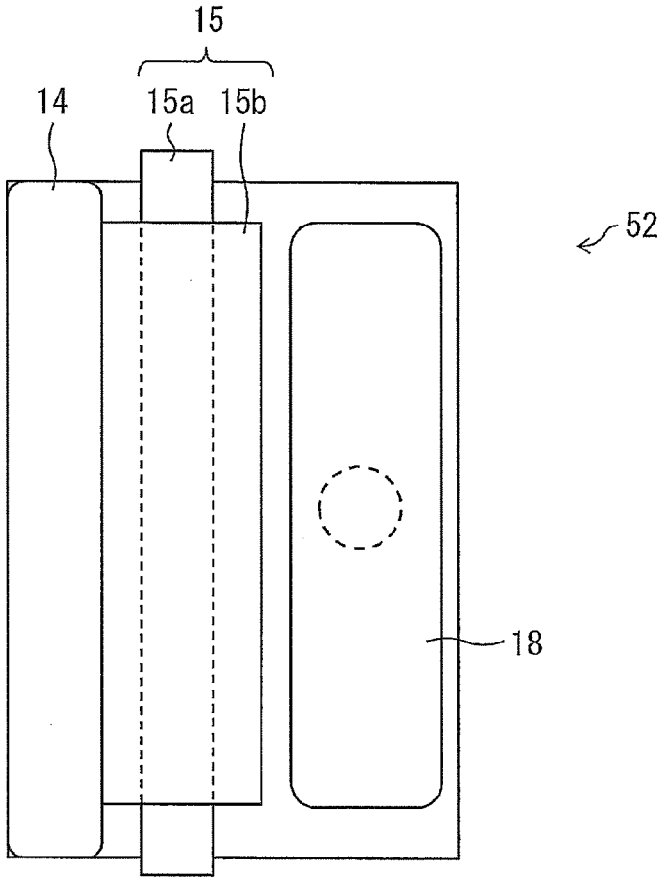

Referring to FIGS. 6A and 6B, the serial powdering unit 52 is described in more detail. FIG. 6A is a lateral sectional view of the serial powdering unit 52. FIG. 6B is a schematic upper view of the serial powdering unit 52.

As illustrated in FIG. 6A, the serial powdering unit 52 has a powdering roller (applicator) 15, a stirring roller 16, a powdering head 14, and a feeding bottle (feeder) 18.

As illustrated in FIGS. 6A and 6B, the serial powdering unit 52 has the powdering roller 15 that stirs and applies the powder, and the stirring roller 16 that stirs and supplies the powder to underneath of the powdering roller 15. The serial powdering unit 52 applies the powder, by using the powdering roller 15, on the medium 20 transferred above the serial powdering unit 52.

The powder can be stirred well by the powdering roller 15 and the stirring roller 16 both, and aggregated particles of the powder are thereby favorably loosened.

The serial powdering unit 52, by making the powdering roller 15 scoop up the powder from underneath of the powdering roller 15, applies the powder on the medium 20. Any excess of the powder adhered to the powdering roller 15, before reaching the medium 20, drops under its own weight on the bottom of the powdering head 14. The serial powdering unit 52 can adjust the quantity of the powder to be applied through the rotation of the stirring roller 16 and the powder weight. The powder can accordingly be applied equally on the medium 20.

The powdering roller 15 has bristles 15*b* attached to a rotating shaft 15*a*. Instead of using the bristles 15*b*, the powdering roller may apply the powder with, for example, a cloth puff. The powdering roller 15 may be rotated or oscillated back and forth to apply the powder on the medium 20. This further ensures that the powder is applied equally on the medium 20. The powdering roller 15 may be rotated by making the bristles 15*b* contact the medium 20, or may be rotated or oscillated back and forth by a driving unit (not illustrated in the drawings).

[Stirring Roller 16]

The stirring roller 16 has a rotating shaft 16*a* and a large number of grooves 16*b* formed along the rotating shaft 16*a*. The stirring roller 16 thus structured, while stirring the powder supplied from the feeding bottle 18, supplies the stirred powder to underneath of the powdering roller 15.

The stirring roller 16, instead of using a large number of grooves 16*b*, may supply the powder to underneath of the powdering roller 15 by rotating spiral blades or inclined slits. Optionally, a detector for detecting loss of the powder supplied to underneath of the powdering roller 15 may be further provided. With a decreasing quantity of the powder, the stirring roller 16 is rotated or oscillated back and forth to supply the powder from the feeding bottle 18.

The feeding bottle 18 is removably attached to the serial powdering unit 52 as illustrated in FIGS. 6A and 6B. The feeding bottle 18 including its container may be replaced with a new one when all of the powder is used up.

[Laminate Solution]

The laminate solution is spread on the ink layer formed on the medium to form the laminate layer thereon for protection of, for example, an image printed on the medium. The laminate layer serves the purpose of improving rub fastness and resistance to light of a printed matter. By using the laminate solution, printed matters that can be exhibited outdoors or directly touched by viewers are obtainable. A water-based laminate solution or an oil laminate solution may be suitably selected as the laminate solution.

In the case of spreading the laminate solution after the ink is discharged on the medium 20, the inkjet printing device according to the disclosure may apply the powder on the laminate layer to prevent possible blocking of the laminate layer as well. Therefore, a film laminating process is unnecessary to obtain printed matters that can be exhibited outdoors or directly touched by viewers. A printed matter obtained by the inkjet printing device according to the disclosure is coated with the powder. Such a printed matter is practically free from stains, for example, fingerprints.

This embodiment has described the use of the laminate solution in the inkjet printing device 102. The inkjet printing devices according to the other embodiments may be provided with the laminate coating head that applies the laminate solution to prevent possible blocking of the laminate layer.

[Inkjet Printing Device 103]

Figure 5C:
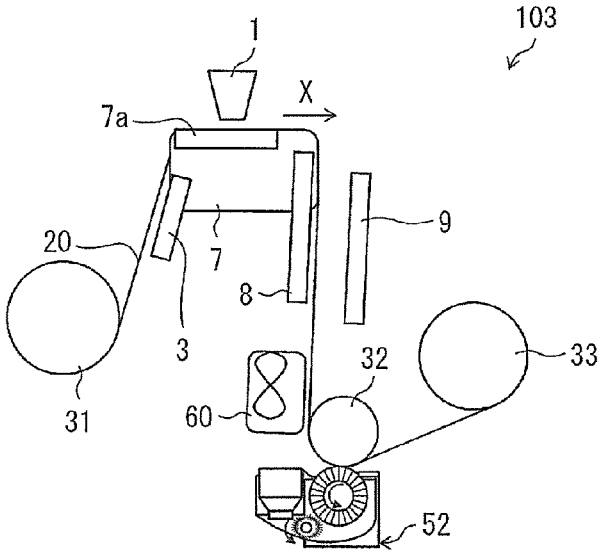

An inkjet printing device 103 according to an embodiment (fourth embodiment) of the disclosure is described referring to FIG. 5C.

The description of this embodiment focuses on differences from the third embodiment. Any structural elements of the device functionally similar to those according to the third embodiment are given the same reference symbols, and will not be described again.

In the inkjet printing device 103, the return roller 32 is located in contact with the printed surface of the medium 20, and the powder is applied by the serial powdering unit 52 on the back surface of the medium 20 opposite to its ink-discharged surface. The inkjet printing device 103 thus structured can be reduced in width in the transferring direction of the medium 20 as with the inkjet printing devices 101 and 102 according to the second and third embodiments.

[First Modified Embodiment]

Figure 3C:
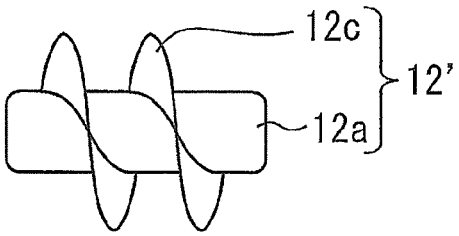

The inkjet printing device according to the disclosure is not limited to the devices described in the first to fourth embodiments. In an inkjet printing device according to a modified embodiment (first modified embodiment), a powdering roller 12' of the serial powdering unit is in the form of a screw with spiral blades 12*c* attached to the rotating shaft 12*a*. As illustrated in FIG. 3C, the powder is stirred by rotating the screw-shaped powdering roller 12', and aggregated particles of the powder can be thereby loosened. The powder can accordingly be applied equally on the medium 20.

The spiral blades 12*c* of the powdering roller 12' are preferably mounted on the powdering head 13 so as to avoid any contact with the medium 20 or the platen 7. Additionally, a tire (not illustrated in the drawings) having an elastic member allowed to contact the platen 7 or the medium 20, such as a rubber member, is preferably provided on at least one end of the rotating shaft 12*a* in its lengthwise direction.

When the serial powdering unit 50 is moving in the Y direction along the Y-bar 6, the powdering roller 12' can be rotated by the tire in contact with the platen 7 or the medium 20. During the rotation of the powdering roller 12', therefore, the printed surface of the medium 20 is not damaged by the spiral blades 12*c*, and the powder is safely stirred by the powdering roller 12' and applied on the medium 20. Of course, the powdering roller 12' may be rotated by, instead of the tire, a driving unit (not illustrated in the drawings), such as a motor, installed in the end part of the rotating shaft 12*a*.

[Second Modified Embodiment]

Figure 4A:
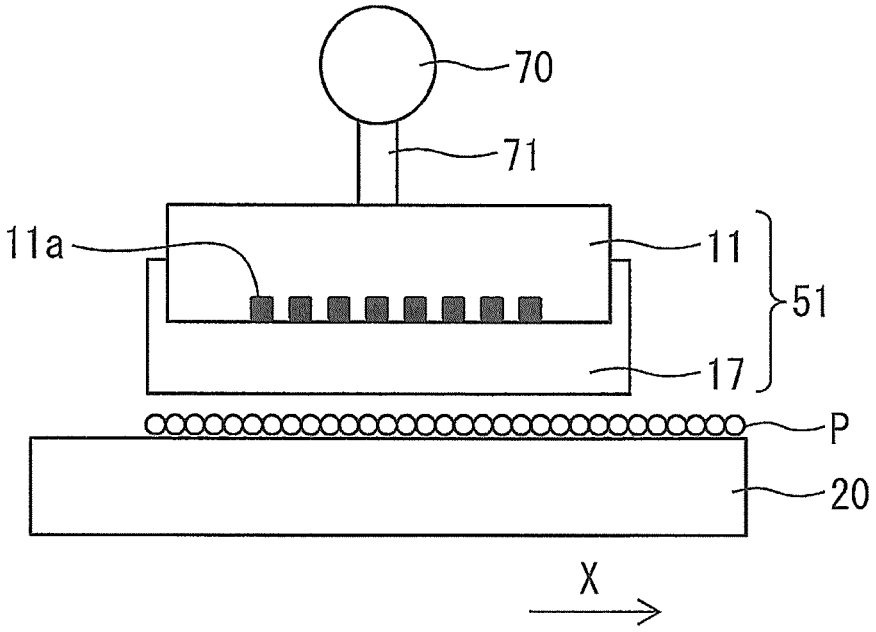
FIGS. 4A-4B are schematic drawings of a serial powdering unit according to a modified embodiment installed in the inkjet printing device according to the embodiment of the disclosure.
Figure 4B:
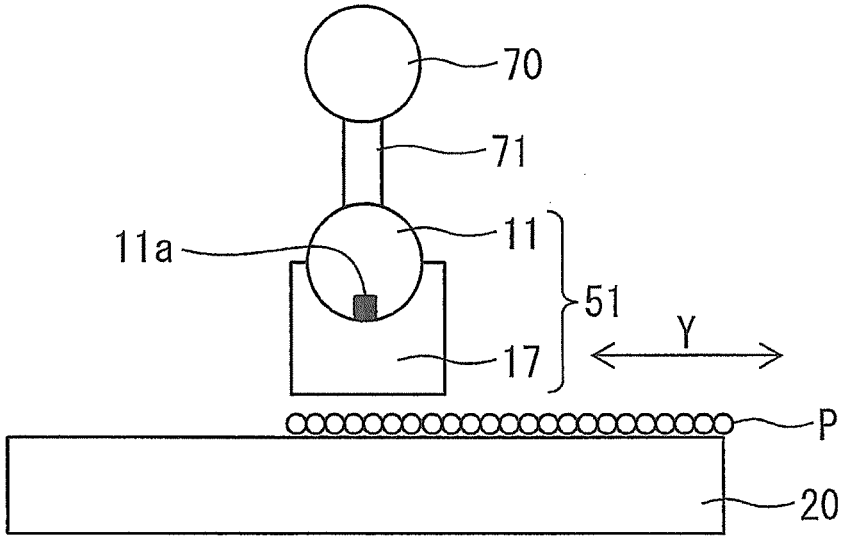

The inkjet printing device according to the disclosure is not limited to the devices described in the first to fourth embodiments and the first modified embodiment. In an inkjet printing device according to a modified embodiment (second modified embodiment), as illustrated in FIGS. 4A and 4B, the powder P is flown into a powdering head 17 by air supplied from a compressor 70 through a tube 71 and then applied on the medium 20 by a serial powdering unit 51.

The serial powdering unit 51 is movable along the Y-bar 6. As illustrated in FIGS. 4A and 4B, the serial powdering unit 51 is formed so that the lengthwise direction of the powdering head 17 intersects the Y direction that is the scanning direction of the serial powdering unit 51. Accordingly, even in the case of using a smaller head as the powdering head 17, the serial powdering unit 51 can similarly apply the powder in one scan in an area large enough. Thus, the powdering head 17 and the serial powdering unit 51 can be reduced in size.

The powdering head 17 in smaller sizes helps to stabilize the concentration of the powder flown by air into the powdering head 17. The serial powdering unit 51 can, therefore, apply the powder stable in concentration on the medium 20.

[Third Modified Embodiment]

The inkjet printing device according to the disclosure is not limited to the devices described in the first to fourth embodiments and the first and second modified embodiments. In an inkjet printing device according to a modified embodiment (third modified embodiment), the powder applying unit may include a plurality of serial powdering units. In the inkjet printing device according to the modified embodiment, as illustrated in FIG. 1C, a powdering equipment 40' includes serial powdering units 50 and 50' attached to the Y-bar 6.

In the device thus structured, the serial powdering units 50 and 50' can both take charge of applying the powder on the medium. Therefore, the inkjet printing device according to the modified embodiment can more efficiently apply the powder. This modified embodiment uses two serial powdering units. The number of the serial powdering units is optionally increased in accordance with the structural characteristics of the printing device and the width dimension of a medium to be used.

[Fourth Modified Embodiment]

The inkjet printing device according to the disclosure is not limited to the devices described in the first to fourth embodiments and the first, second, and third modified embodiments. In an inkjet printing device according to a modified embodiment (fourth modified embodiment), the powdering equipment has a tube with a plurality of through holes formed therein, wherein the powder supplied into the tube is applied on the medium through the plurality of through holes. The powdering equipment according to the modified embodiment supplies the powder flown by air from, for example, a compressor into the tube having the plural through holes and then applies the powder through the plural through holes on the medium.

Thus, the powder can be applied on the medium 20 by such a simple structure.

[Other Modified Embodiment]

In the above embodiments and modified embodiments, the serial powdering unit applies the powder by using the powdering roller or by making the powder be flown by air. In an inkjet printing devices according to an embodiment, however, a serial powdering unit is not necessarily so structured. The serial powdering unit may electrostatically apply the powder on the medium 20. The serial powdering unit may apply the powder on the medium 20 by allowing the powder to drop under its own weight.

The feeder of the serial powdering unit is not limited to the feeding bottle 11 or 18 described in the embodiments. The feeder may supply the powder from a cartridge in which the powder is reserved. The feeder may supply the powder to the powdering head of the serial powdering unit through a tube.

[Inkjet Printing Method]

An inkjet printing method according to an embodiment of the disclosure, for example, may use the inkjet printing device 100 according to the disclosure.

An inkjet printing method according to the embodiment includes: a printing step of discharging an ink on a medium 20 through an inkjet head 1 to carry out printing; a transferring step of moving the medium 20 and the inkjet head 1 relative to each other; and a powder applying step of applying a powder on the medium 20 on a downstream side relative to the inkjet head 1 in a transferring direction during the transferring step.

[Printing Step]

In the printing step, the inkjet head 1 discharges the ink on the medium 20 to print an object thereon. The inkjet head 1, while moving in the direction (Y direction) intersecting the transferring direction of the medium 20 (X direction), discharges the ink on the medium 20.

[Transferring Step]

In the transferring step, the transferring roller transfers the medium 20 in the X direction for relative movements between the medium 20 and the inkjet head 1. By performing the printing step and the transferring step in parallel, printing can be continuously performed on the medium 20.

[Powder Applying Step]

In the powder applying step, the serial powdering unit 50 of the powdering equipment 40 moving in the Y direction applies the powder on the surface with the ink discharged thereon through the inkjet head 1.

This step can effectively prevent the occurrence of blocking of, specifically, any semi-dried printed matter, shortening an idle time before the medium is ready to be wound in a roll to be retrieved. As a result, a higher printing speed is achieved. Moreover, a stage of the device necessary for drying the printed recording medium can reduce in length, succeeding in downsizing the inkjet printing device.

In the powder applying step, the serial powdering unit 50 preferably applies the powder in a larger extent than the printing width of the inkjet head 1. Therefore, an adequate quantity of powder can be spread on, for example, a printed image far enough to reach edges of the image. More specifically, as illustrated in FIG. 1B, the serial powdering unit 50 preferably applies the powder across a width dimension A which is the width of the platen 7, more preferably applies the powder across a width dimension B which is the width of the medium 20, and most preferably applies the powder across a width dimension C which is the width of the printing region R. Accordingly, the serial powdering unit 50 can apply the powder in an area large enough to prevent the occurrence of blocking without overusing the powder.

In the powder applying step, preferably, the powdering roller 12 of the serial powdering unit 50 stirs and applies the powder on the medium 20. The powdering roller 12 applies the powder on the medium 20 while loosening aggregated particles of the powder. The powder can accordingly be applied equally on the medium 20.

In the powder applying step, plural serial powdering units 50 may be used to apply the powder on the ink-discharged medium 20. The powder can accordingly be applied more efficiently on the medium 20.

[Other Embodiment]

The inkjet printing method is not limited to the embodiment described so far. According to an embodiment, the method may include a heating step of heating the medium between the printing step and the powder applying step, and a cooling step of cooling the heated medium between the heating step and the powder applying step. According to another embodiment, applying the laminate solution may be performed between the printing step and the powder applying step.

[Heating Step]

In the heating step, the ink discharged on the medium 20 is heated by a heater such as an after-heating unit. This can suitably prevent the incomplete drying of the ink, thereby effectively preventing the occurrence of blocking that may be caused by failure to fully dry the ink.

When the laminate solution is applied on the medium 20 after the printing step to protect the ink layer, the heating step preferably dries the ink to an extent that is not blurred by the laminate solution. Specifically, the ink is preferably dried until the solvent of the ink discharged on the medium 20 is evaporated by 20% or more of a total ink weight before the discharge starts. This ensures that the ink layer formed on the medium 20 is not blurred by the laminate solution.

To spread the laminate solution after the printing step, the ink layer and the laminate layer are preferably dried in the heating step until 85 wt. % or more of the solvents of the ink and the laminate solution are evaporated. This effectively prevents the blocking that may occur if the solvents of the ink layer and the laminate layer are not dry enough.

[Cooling Step]

After the medium 20 is heated by the heating step, the cooling step cools the medium 20 prior to the powder applying step. This prevents the powder applied in the powder applying step from infiltrating into the ink layer, roughening its surface.

The cooling step preferably cools the medium 20 down to temperatures lower than the glass transition temperature of the resin contained in the ink. In the case of applying the laminate solution on the ink layer, the cooling step preferably cools the medium 20 down to temperatures lower than the glass transition temperature of the resin contained in the laminate solution. The cooling step can reduce a degree of heat-induced tackiness of the ink layer and the laminate layer formed on the medium 20. This prevents the powder from infiltrating into the ink layer and the laminate layer, roughening their surfaces when the printed medium 20 is, for example, wound in a roll to be retrieved.

According to yet another embodiment, the inkjet printing method according to the disclosure may further include a return step of returning the medium 20 in a direction reverse to the transferring direction subsequent to the printing step.

By further including this step, the powder can be applied on the back surface opposite to the ink-discharged surface. Accordingly, when the medium 20 is retrieved after the powder applying step, the powder applied on the back surface opposite to the ink-discharged surface serves to prevent the occurrence of blocking of the ink-discharge surface.

The return roller 32 can return the medium 20 in the direction reverse to the transferring direction. As a result, a stage of the device for transferring the medium 20 can reduce in length, allowing downsizing of the inkjet printing device.

[Additional Points]

As described so far, the inkjet printing device 100 according to an embodiment of the disclosure includes: the inkjet head 1 for discharging the ink on the medium 20 to carry out printing; the transferring roller for moving the medium 20 and the inkjet head 1 relative to each other; and the powdering equipment 40 for applying the powder on the medium 20, wherein the powdering equipment 40 is located on the downstream side relative to the inkjet head 1 in the transferring direction by the transferring roller.

According to the device thus characterized, when the medium 20 is, for example, wound in a roll to be retrieved, the ink on the medium 20 is prevented from bleeding through to or sticking (blocking) to the back surface of the medium 20 opposite to its ink-discharged surface. This prevents such an incident that some mottled effect is left on the ink-discharged surface of the medium 20.

By applying the powder after the printing is done by the inkjet printing device 100, the occurrence of blocking of a semi-dried printed matter is effectively prevented. This shortens an idle time before the medium 20 is ready to be wound in a roll to be retrieved. The inkjet printing device 100 can accordingly improve its printing speed.

Moreover, a stage of the device necessary for drying the printed medium 20 can reduce in length, allowing downsizing of the inkjet printing device 100.

In the inkjet printing device 100 according to the embodiment of the disclosure, the powdering equipment 40 includes the serial powdering unit 50 that moves in the direction (Y direction) intersecting the transferring direction (X direction) and applies the powder.

After the printing, such a device can equally apply the powder even on the medium 20 having a large width.

In the inkjet printing device 100 according to the embodiment of the disclosure, the serial powdering unit 50 includes the feeding bottle (feeder) 11 that supplies the powder, and the powdering roller (applicator) 12 that stirs and applies the powder supplied from the feeding bottle 11.

Then, the powder supplied from the feeding bottle 11 can be stirred by the powdering roller 12 to loosen any aggregated particles of the powder. The powder, whose aggregated particles have been loosened by the powdering roller 12, can be applied equally on the medium 20.

In the inkjet printing device 100 according to the embodiment of the disclosure, the serial powdering unit 50 moves in a larger extent than the printing width of the inkjet head 1.

The powdering unit thus characterized can spread an adequate quantity of powder on, for example, a printed image far enough to reach edges of the image. This avoids any insufficiency of the powder to be applied on the medium 20, more effectively preventing the occurrence of blocking.

In the inkjet printing device 100 according to the embodiment of the disclosure, the powdering equipment 40 has the tube with plural through holes formed therein, wherein the powder supplied into the tube is applied on the medium 20 through the plural through holes.

The powder can be applied on the recording medium by such a simple structure.

In the inkjet printing device 101 according to an embodiment of the disclosure, the powdering equipment 40 applies the powder on the back surface of the medium 20 opposite to its ink-discharged surface when the transferred medium 20 is returning in the direction reverse to the transferring direction.

When the medium 20 is retrieved by using, for example, the take-up roll 33, the powder applied by the powdering equipment 40 on the back surface opposite to the ink-discharged surface serves to prevent the occurrence of blocking of the ink-discharged surface.

In the inkjet printing device 101 structured to return the medium 20 in the direction reverse to the transferring direction, a stage for transferring the medium 20 can be reduced in length, and the device can consequently be reduced in size.

The inkjet printing device 100 or 101 according to one of the embodiments of the disclosure preferably further includes the after-heating unit 8 for heating the ink printed on the medium 20 between the powdering equipment 40 and the inkjet head 1.

With the after-heating unit 8 further installed in the device, the ink discharged on the medium 20 can be thereby heated to prevent failure to fully dry the ink. This more effectively prevents the occurrence of blocking.

The inkjet printing device 102 or 103 according to one of the embodiments of the disclosure further includes the cooling unit 60 for cooling the medium 20, wherein the cooling unit 60 is located on the downstream side relative to the after-heating unit 8 and on at least one of the upstream and downstream sides relative to the powdering equipment 41 in the transferring direction.

The cooling unit further installed in the device can cool the ink discharged on the medium 20 subsequent to the heat drying by the after-heating unit 8. Then, the ink layer becomes cool enough to reach temperatures lower than the glass-transition temperature of the resin contained in the ink, reducing a degree of heat-induced tackiness of the ink layer. This prevents the powder from infiltrating into the ink layer, roughening its surface when the printed medium 20 is, for example, wound in a roll to be retrieved.

The inkjet printing method according to the embodiment of the disclosure includes: the printing step of discharging the ink on the medium 20 through the inkjet head 1 to carry out printing; the transferring step of moving the medium 20 and the inkjet head 1 relative to each other; and the powder applying step of applying the powder on the medium 20 on the downstream side relative to the inkjet head 1 in the transferring direction during the transferring step.

The method exerts advantageous effects similar to the effects of the inkjet printing device 100 according to the disclosure.

The disclosure is not necessarily limited to the embodiments described so far and may be carried out in many other forms. The technical scope of the disclosure encompasses any modifications within the scope of the disclosure defined by the appended claims and embodiments obtained by variously combining the technical means disclosed herein.

EXAMPLES

[Blocking Evaluation]

In an example 1, an inkjet printer (product name: JV33-130 manufactured by MIMAKI ENGINEERING CO., LTD.) mounted with the serial powdering unit according to the first embodiment was prepared. In a comparative example 1, a printer of the same type JV33-130 was prepared wherein the serial powdering unit was not provided. A blocking preventive effect was evaluated with these inkjet printers according to the example 1 and the comparative example 1.

As the printing conditions in the example 1 and the comparative example 1, printing mode was 540×1080 dpi, number of passes was 12, two-layer printing was performed, and discharged ink was 33 cc/$m^2$. The printed media were transferred on a 0.2 m-long after-heating unit and thereby heated to dry the ink.

The inkjet printer according to the example 1 transferred the medium on the 0.2 m-long after-heating unit and applied the powder on an ink-discharged surface of the medium by using the serial powdering unit.

Then, the medium was wound in a roll to evaluate whether or not any blocking-caused mottled effect was visually confirmed.

[Evaluation]

A circle (○) represents a medium whose ink-discharged surface had no mottled effect, whereas a cross (×) represents a medium whose ink-discharged surface had any mottled effect.

The evaluation test confirmed that no blocking-caused mottled effect was visually detected on an image printed by the inkjet printer according to the example 1 (○). The evaluation test also confirmed that some blocking-caused mottled effect was visually detected on an image printed by the inkjet printer according to the comparative example 1 (×).

The disclosure is applicable to inkjet printing devices.

What is claimed is:

1. An inkjet printing device, comprising:

an inkjet head for discharging an ink on a recording medium to carry out a printing;

a transferring unit for moving the recording medium and the inkjet head relative to each other; and a powder applying unit for applying a powder remained in a powder state on the recording medium, the powder applying unit being located on a downstream side relative to the inkjet head in a transferring direction by the transferring unit.

2. The inkjet printing device according to claim 1, wherein the powder applying unit comprises:

a serial powdering unit that moves in a direction intersecting the transferring direction and applies the powder.

3. The inkjet printing device according to claim 2, wherein the serial powdering unit comprises:

a feeder for supplying the powder, and an applicator for stirring and applying the powder supplied from the feeder.

4. The inkjet printing device according to claim 2, wherein the serial powdering unit moves in a larger extent than a printing width of the inkjet head.

5. The inkjet printing device according to claim 3, wherein the serial powdering unit moves in a larger extent than a printing width of the inkjet head.

6. The inkjet printing device according to claim 1, wherein the powder applying unit has a tube with a plurality of through holes formed therein, wherein the powder supplied into the tube is applied on the recording medium through the plurality of through holes.

7. The inkjet printing device according to claim 1, wherein the powder applying unit applies the powder to a back surface of the recording medium opposite to an ink-discharged surface thereof when the transferred recording medium is returning in a direction reverse to the transferring direction.

8. The inkjet printing device according to claim 1, further comprising:

an after-heating unit for heating the ink printed on the recording medium between the powder applying unit and the inkjet head.

9. The inkjet printing device according to claim 8, further comprising:

a cooling unit for cooling the recording medium, wherein the cooling unit is located on a downstream side relative to the after-heating unit and on at least one of upstream and downstream sides relative to the powder applying unit in the transferring direction.

10. An inkjet printing method, comprising:

a printing step of discharging an ink on a recording medium through an inkjet head to carry out a printing;

a transferring step of moving the recording medium and the inkjet head relative to each other; and a powder applying step of applying a powder remained in a powder state on the recording medium on a downstream side relative to the inkjet head in a transferring direction during the transferring step.

* * * * *